United States Patent [19]

Prather

[11] Patent Number: 4,716,925

[45] Date of Patent: Jan. 5, 1988

[54] REVERSIBLE WASHING MACHINE BOX

[75] Inventor: Charles R. Prather, Germantown, Tenn.

[73] Assignee: Industrial Polychemical Service, Inc., Gardena, Calif.

[21] Appl. No.: 65,594

[22] Filed: Jun. 23, 1987

[51] Int. Cl.[4] ..... F16L 5/00

[52] U.S. Cl. ..... 137/360; 137/270; 285/12; 4/191; 312/229

[58] Field of Search ..... 137/360, 362, 270; 220/3.92, 3.94; 4/DIG. 7, 191, 192; 285/12, 64; 312/229, 242

[56] References Cited

U.S. PATENT DOCUMENTS

| | | | |
|---|---|---|---|
| 995,203 | 6/1911 | Thomas | 285/12 X |
| 4,158,471 | 6/1979 | Logsdon | 312/242 X |
| 4,410,004 | 10/1983 | Kifer | 137/360 |
| 4,564,249 | 1/1986 | Logsdon | 312/229 |

*Primary Examiner*—Harold W. Weakley
*Attorney, Agent, or Firm*—Walker & McKenzie

[57] ABSTRACT

A reversible side outlet washing machine box for being mounted between two adjacent studs in a wall and for allowing first and second water supply lines and a drain line to be coupled to the first and second water hoses and drain hose, respectively, of a washing machine. The box includes a first side wall; a second side wall; and a base member having a first and a second end; the base member extends between the first and second side walls and is reversible to allow either the first or second end thereof to be attached to either the first or second side wall; the first water supply line and the first water hose being attachable to the base member adjacent the first end thereof, the second water supply line and the second water hose being attachable to the base member intermediate the first and second ends thereof, the drain line and the drain hose being attachable to the base member adjacent the second end thereof.

17 Claims, 13 Drawing Figures

FIG. 7
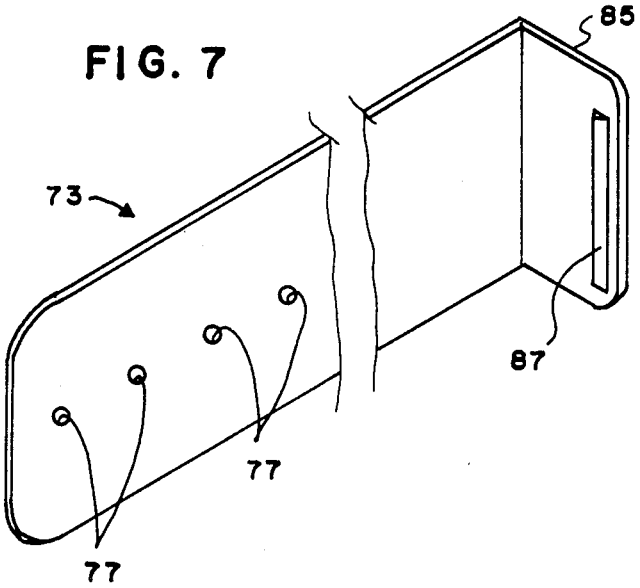
FIG. 8
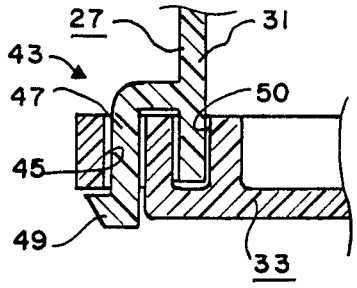
FIG. 9
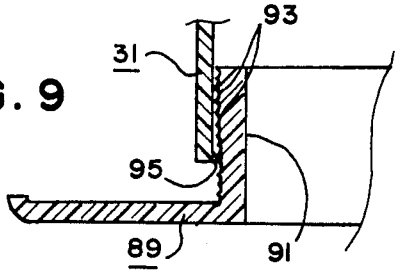
FIG. 10
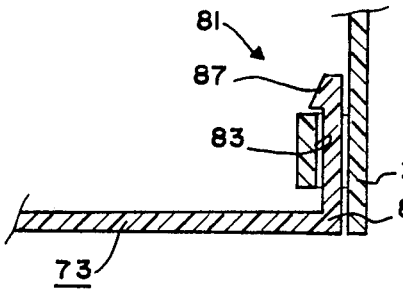
FIG. 11
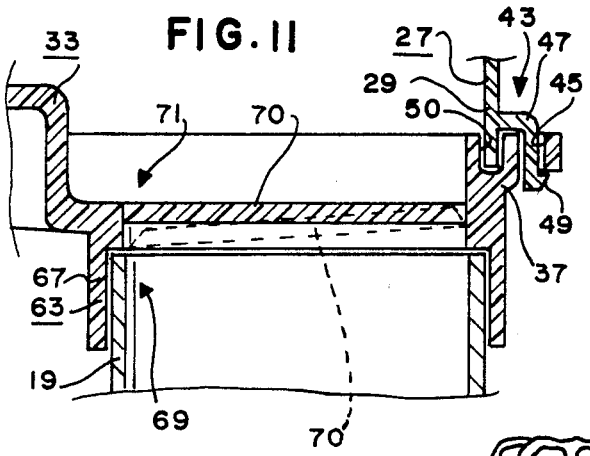
FIG. 12
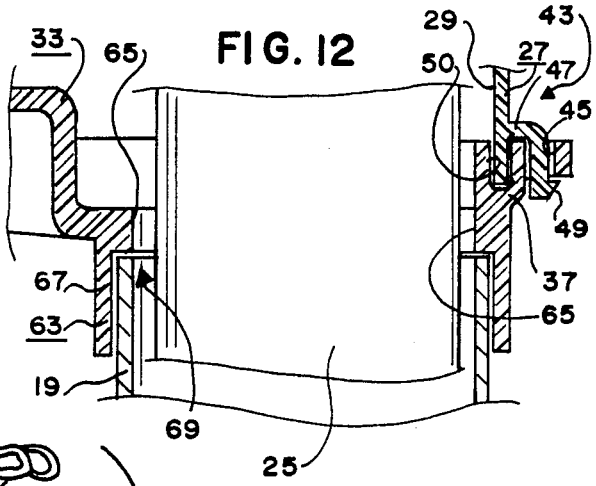
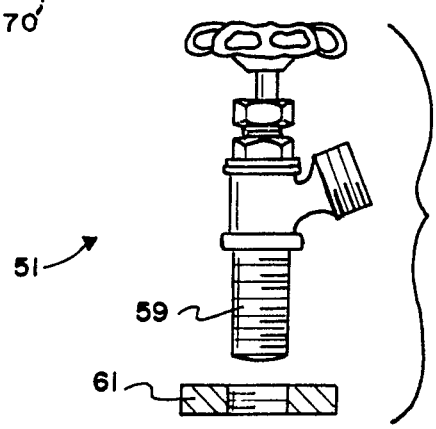
FIG. 13

REVERSIBLE WASHING MACHINE BOX

BACKGROUND OF THE INVENTION

1. Field of the Invention

The present invention relates in general to boxes for use in attaching washing machine water and drain hoses to wall water outlet and drain lines.

2. Description of the Related Art

Open face boxes have been heretofore mounted in walls for allowing washing machine water and drain hoses to be attached to water outlet and drain lines.

One common type of such prior art boxes typically includes a substantially rigid rectangular frame for being fixedly attached to two adjacent studs of the wall by way of ears and nails or the like. A first water valve is attached to the bottom of the frame adjacent one side wall thereof to allow a first water outlet line and a first washing machine water hose to be attached thereto. A second valve is attached to the bottom of the frame adjacent the other side wall thereof to allow a second water outlet line and a second washing machine water hose to be attached thereto. A coupling member is attached to the bottom of the frame between the first and second water valves to allow a drain line and a washing machine drain hose to be attached thereto. The drain line includes a typical P-trap assembly. One problem with such prior art washing machine boxes is the requirement that one of the water outlet lines crosses over the P-trap assembly. Such cross overs are difficult and time consuming for the plumber and/or installer of the washing machine box, etc., and often prevent smooth installation of wall board or the like.

Another type of such prior art boxes also includes a substantially rigid rectangular frame for being fixedly attached to two adjacent studs of the wall by way of ears and nails or the like with a first water valve attached to the bottom of the frame adjacent one side wall thereof to allow a first water outlet line and a first washing machine water hose to be attached thereto. However, the coupling member is attached to the bottom of the frame adjacent the other side wall and the second valve is attached to the bottom of the frame between the first water valve and the coupling member to allow a drain line and a washing machine drain hose to be attached to the frame adjacent one side wall thereof. One problem with such prior art washing machine boxes is the requirement that separate boxes be produced for installing the drain line and drain hose on the right and left of the water lines, etc.

The present invention is not disclosed or suggested by any known prior art.

SUMMARY OF THE INVENTION

The present invention is directed toward providing an improved washing machine box for use in attaching washing machine water and drain hoses to wall water outlet and drain lines.

The present invention comprises, in general, a reversible side outlet washing machine box for being mounted between two adjacent studs in a wall and for allowing first and second water supply lines and a drain line to be coupled to the first and second water hoses and drain hose, respectively, of a washing machine. The box includes a first side wall; a second side wall; and a base member having a first end and a second end; the base member extends between the first and second side walls and is reversible to allow either the first or second end thereof to be attached to either the first or second side wall; the first water supply line and the first water hose being attachable to the base member adjacent the first end thereof, the second water supply line and the second water hose being attachable to the base member intermediate the first and second ends thereof, the drain line and the drain hose being attachable to the base member adjacent the second end thereof.

BRIEF DESCRIPTION OF THE DRAWINGS

FIG. 7 is a perspective view of one of the ear members of the box of the present invention.

FIG. 8 is a sectional view of portion of the box of the present invention showing the attachment of the base member with a side wall of the frame.

FIG. 9 is a sectional view of a portion of the box of the present invention showing the attachment of the face plate with a side wall of the frame.

FIG. 10 is a sectional view of portion of the box of the present invention showing the attachment of an ear member with a side wall of the frame.

FIG. 11 is a sectional view of a portion of the box of the present invention showing the attachment of a drain line with the base member of the frame.

FIG. 12 is a sectional view similar to FIG. 11 but showing the addition of the drain hose.

FIG. 13 is an exploded view of a valve member of the box of the present invention.

DESCRIPTION OF THE PREFERRED EMBODIMENT

Figure 1:
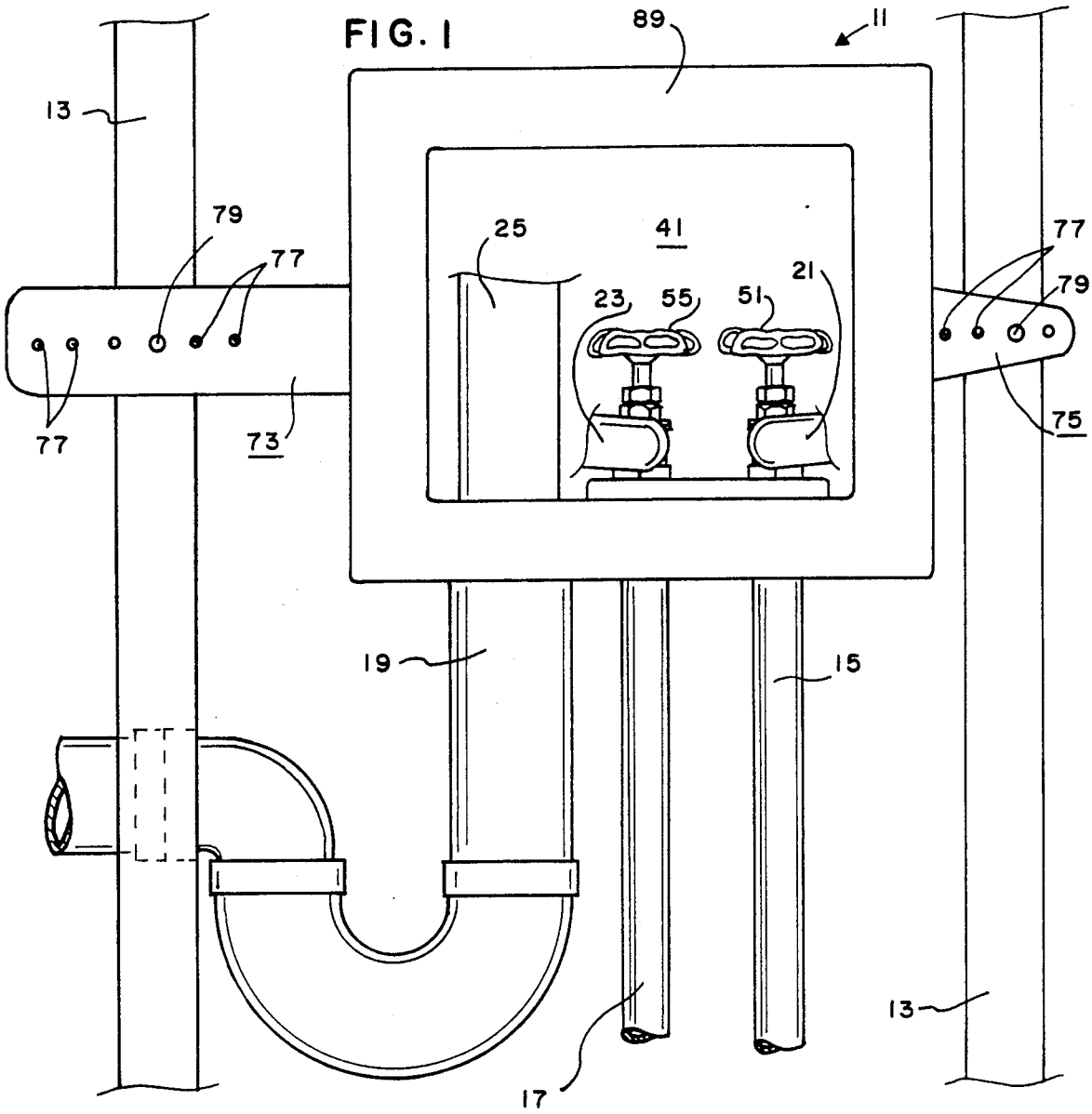
FIG. 1 is a somewhat diagrammatic front elevational view of the washing machine box of the present invention shown associated with a pair of adjacent wall studs, a pair of water supply lines, a drain line, a pair of water hoses, and a drain hose.

The preferred embodiment of the reversible side outlet washing machine box 11 of the present invention is for being mounted between two adjacent studs 13 in a wall and for allowing first and second (e.g., hot and cold) water supply lines 15, 17, respectively, and a drain line 19 to be coupled to first and second (e.g., hot and cold) water hoses 21, 23 and drain hose 25, respectively, of a washing machine (see, in general, FIG. 1).

Figure 2:
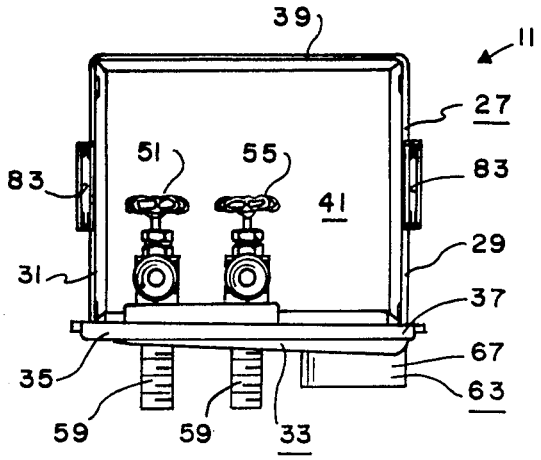
FIG. 2 is a front elevational view somewhat similar to FIG. 1 but showing the base member of the box reversed and with portions thereof omitted for clarity.
Figure 3:
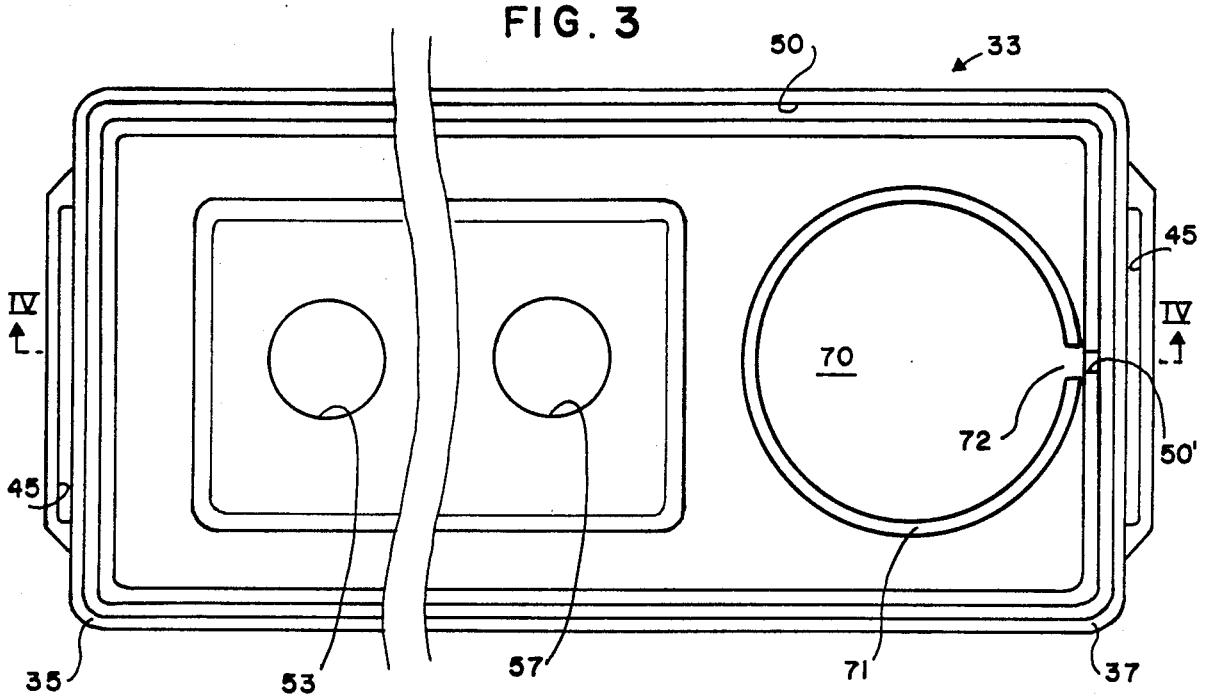
FIG. 3 is a top plan view of the base member of the box of the present invention.

The box 11 includes an open face frame 27 (see, in general, FIG. 2). The frame 27 has a first side wall 29, a second side wall 31 and a base member 33. The base member 33 has a first end 35 and a second end 37 (see, in general, FIGS. 3 and 4). In the position shown in FIG. 1, the base member 33 extends between the first and second side walls 29, 31 with the first end 35 secured to the first side wall 29 and with the second end 37 secured to the second side wall 31. The base member 33 is reversible from the position shown in FIG. 1 to the position shown in FIG. 2, or vice versa, to allow the second end 37 either to be secured to the first side wall 29 and the first end 35 to be secured to the second side wall 31 as indicated in FIG. 2 or to be secured as previously described relative to FIG. 1. The frame 27 preferably includes a top member 39 extending between the top ends of the side walls 29, 31 to one another and a back member 41 joining the side walls 29, 31 and the top member 39 whereby the frame 27 forms a generally rectangular, open face box-like unit. The side walls 29, 31, top member 39 and back member 41 are preferably constructed as an integral, one-piece unit. The frame 27 preferably includes attachment means 43 for allowing the base member 33 to be removably secured to the lower ends of the side walls 29, 31 (see, in general, FIG. 8). More specifically, a slot 45 may be provided in the first and second ends 35, 37 of the base member 33 (see, in general, FIGS. 3 and 4) and one or more projections 47 may be provided on the lower ends of the first and second side walls 29, 31 (see, in general, FIG. 5) for extending into respective slots 45 to secure the base member 33 to the side walls 29, 31 as will now be apparent to those skilled in the art. Each projection 47 preferably has one or more finger portion 49 for securely gripping one side of the corresponding slot 45 to securely attach the base member 33 to the side walls 29, 31 while allowing the base member 33 to be removed from the side walls 29, 31 by prying the sides of the slots 45 and the finger portions 49 away from one another using a screw driver or the like as will now be apparent to those skilled in the art. The base member 33 may have an upwardly directed groove 50 extending about the periphery thereof for receiving the lower ends of the side walls 29, 31 and the back member 41 to insure proper alignment thereof and to enhance the attachment therebetween as will now be apparent to those skilled in the art. A slot 50′ may be provided through the interior side of the groove 50 (see FIGS. 3 and 4) for allowing any liquid that may enter the groove 50 to drain therethrough.

The box 11 preferably includes a first valve member 51 attached to the base member 33 adjacent the first end 35 thereof for being coupled to the water supply line 15 and to the water hose 21 (see, in general, FIGS. 1 and 13). The first valve member 51 may consist of a typical gate-type turn-off water valve or faucet of any specific construction and operation now apparent to those skilled in the art. The base member 33 preferably has means such as an aperture 53 therethrough substantially adjacent the first end 35 thereof for allowing the first valve member 51 to be easily attached thereto and for allowing the water supply line 15 to be coupled to the water hose 21 in a manner as will now be apparent to those skilled in the art.

The box 11 preferably includes a second valve member 55 attached to the base member 33 between the first and second ends 35, 37 thereof for being coupled to the water supply line 17 and to the water hose 23 (see, in general, FIG. 1). The second valve member 55 may be identical to the first valve member 51 and may consist of a typical gate-type water turn-off valve or faucet of any specific construction and operation now apparent to those skilled in the art. It should be noted that the first and second valve members 51, 55 may be coupled together as a single unit and controlled by a single lever in a manner and for reasons as will now be apparent to those skilled in the art. The base member 33 preferably has means such as an aperture 57 therethrough in a location between the first and second ends 35, 37 thereof for allowing the second valve member 55 to be easily attached thereto and for allowing the water supply line 17 to be coupled to the water hose 23 in a manner as will now be apparent to those skilled in the art.

The specific manner in which the first and second valve members 51, 55 are secured to the base member 33 may vary as will now be apparent to those skilled in the art. For example, each valve member 51, 55 may include a threaded shank 59 for extending through the respective aperture 53, 57 in the base member 33 and a nut 61 for coacting with the shank 59 to secure the respective valve member 51, 55 to the base member 33 in a manner as will now be apparent to those skilled in the art.

Figure 4:
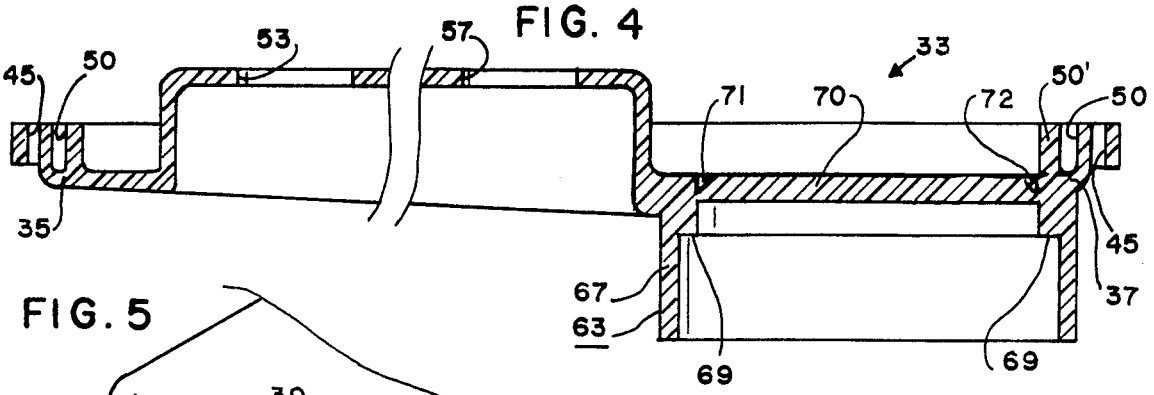
FIG. 4 is a sectional view substantially as taken on line IV—IV of FIG. 3.
Figure 5:
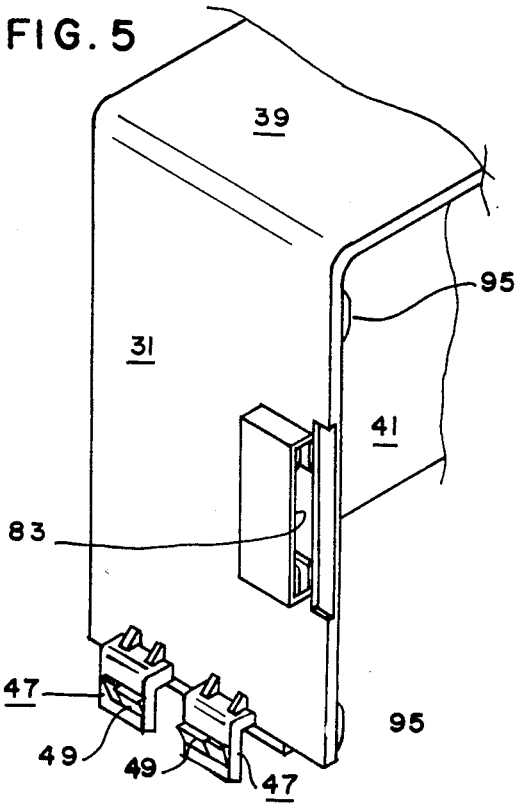
FIG. 5 is a perspective view of a portion of the frame of the box of the present invention.
Figure 6:
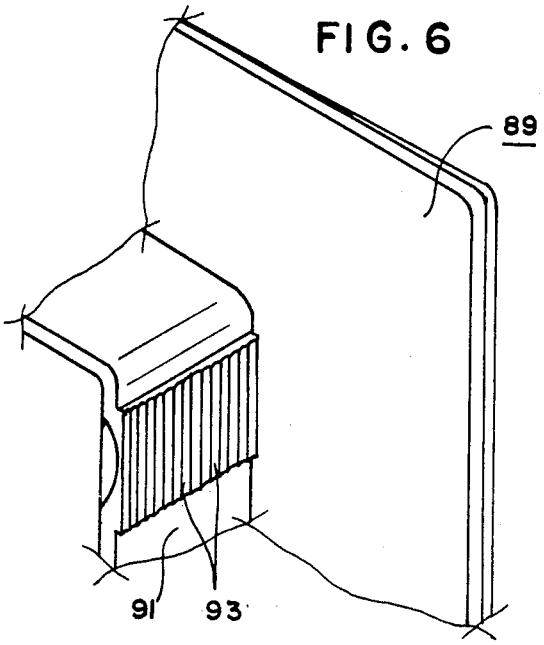
FIG. 6 is a perspective view of a portion of the face plate of the box of the present invention.

The box 11 preferably includes drain coupling means 63 attached to the base member 33 adjacent the second end 37 thereof for allowing the drain line 19 and the drain hose 25 to be operatively coupled relative to one another and to the base member 33 (see, in general, FIG. 4). The drain coupling means 63 may include means such as an aperture 65 through the base member 33 adjacent the second end 37 thereof (see, in general, FIG. 12) and the drain line 19 may be secured to the base member 33 about the aperture 65 whereby the aperture 65 communicates with the interior of the drain line 19 as will now be apparent to those skilled in the art. The drain hose 25 may then be merely positioned through the aperture 65 into the interior of the drain line 19 in a typical manner whereby water will drain through the drain hose 25 into the drain line 19 as will now be apparent to those skilled in the art. The upper surface of the base member 33 may slope toward the aperture 65 to allow any fluid thereon to flow to the aperture 65. The drain coupling means 63 preferably includes a sleeve member 67 extending downwardly from the base member 33 and defining the aperture 65. The interior diameter of the sleeve member 67 is preferably sized so as to allow the upper end of the drain line 19 to be inserted thereinto. The upper end of the sleeve member 67 is preferably provided with an inwardly directed lip 69 to act as a stop for the upper end of the drain line 19 as will now be apparent to those skilled in the art. The drain line 19 can be secured to the drain coupling means 63 in various specific manners now apparent to those skilled in the art such as by being glued thereto.

The box 11 preferably includes a cap 70 for closing the aperture 65 prior to the drain hose 25 being inserted thereinto (see, in general, FIG. 11) to allow the integrity and fluid tightness of the drain line 19 and the connection between the drain line 19 and the drain coupling means 63 to be tested in a manner and for reasons as will now be apparent to those skilled in the art. The cap 70 is preferably formed integral with the base member 33 and defined in part by a groove 71 which allows the cap 70 to be removed from the base member 33 after successful testing by being broken away from the base member 33. More specifically, the groove 71 is preferably discontinuous to form a tab portion 72. To break the cap 70 from the base member 33, pressure is merely applied to the cap 70 at a location substantially opposite the tab portion 72 as by hitting the cap 70 with a hammer or the like. Such pressure will cause the cap 70 to break from the base member 33 about the groove 71 as shown in broken lines in FIG. 11. The cap 70 can then be manually twisted to break the tab portion 72 and free the cap 70 from the base member 33 as will now be apparent to those skilled in the art. The diameter of the cap 70 is preferably larger than the inner diameter of the upper end of the drain line 19 (see, in general, FIG. 11) to prevent the cap 70 from falling into the drain line 19 when the cap 70 is broken away from the base member 33.

The box 11 preferably includes a first ear member 73 and a second ear member 75 extending outward of the opposite sides of the frame 27 and for allowing the frame 27 to be secured to two adjacent studs 13 (see, in general, FIG. 1). Each ear member 73, 75 may have a plurality of spaced apertures 77 therethough for allowing nails 79 to be used to secure the ear members 73, 75 and frame 27 to the studs 13 as will now be apparent to those skilled in the art. The first ear member 73 may be longer than the second ear member 75 and each ear member 73, 75 may be removably attachable to either side of the frame 27 to allow the configuration of the frame 27 and ear members 73, 75 to be varied as will now be apparent to those skilled in the art. The box 11 preferably includes attachment means 81 for allowing the ear members 73, 75 to be removably secured to one of the side walls 29, 31 of the frame 27 (see, in general, FIG. 10). More specifically, a slot 83 may be provided in each side wall 29, 31 and a projection 85 may be provided on each ear member 73, 75 for extending into a respective slot 83 to secure the ear members 73, 75 to the side walls 29, 31 as will now be apparent to those skilled in the art. Each projection 85 preferably has one or more finger portions 87 for securely gripping one side of the corresponding slot 83 to securely attach the respective ear member 73, 75 to the side walls 29, 31 while allowing the ear members 73, 75 to be removed from the side walls 29, 31 by prying the sides of the slots 83 and the finger portions 87 away from one another using a screwdriver or the like as will now be apparent to those skilled in the art. Such a construction (i.e., ear members 73, 75 that are of different lengths and that can be attached to either side wall 29, 31 of the frame 27) allows the box 11 to be mounted at the optimum position between the two adjacent studs 13 as will now be apparent to those skilled in the art.

The box 11 preferably includes a face plate 89 attached to the front of the frame 27 for giving the box 11 a finished appearance, etc. The face plate 89 is preferably adjustable relative to the front of the frame 27 for providing a flush fit thereof with the normal sheetrock or other paneling material used to cover the studs 13 as will now be apparent to those skilled in the art. The face plate 89 preferably includes a sleeve-like portion 91 for slidably fitting into the frame 27 and a plurality of teeth members 93 attached to the sleeve-like portion 91 coacting with teeth members 95 positioned on the inner sides of the side walls 29, 31 of the frame 27 to adjustably mount the face plate 89 to the frame 27 as will now be apparent to those skilled in the art.

The specific construction and size of the box may vary as will now be apparent to those skilled in the art. The frame 27, drain coupling means 63, and face plate 89 are preferably molded out of plastic or the like in any manner as will now be apparent to those skilled in the art. Typical knock outs may be formed in the top member 39 of the frame 27 in any specific manner and form now apparent to those skilled in the art for use with overhead water supply lines in place of the apertures 53, 57. The valve members 51, 55 are preferably commercial, off-the-shelf type items as will now be apparent to those skilled in the art.

Although the present invention has been described and illustrated with respect to a preferred embodiment and a preferred use therefor, it is not to be so limited since modifications and changes can be made therein which are within the full intended scope of the invention.

I claim:

1. A reversible side outlet washing machine box for being mounted between two adjacent studs in a wall and for allowing first and second water supply lines and a drain line to be coupled to the first and second water hoses and drain hose, respectively, of a washing machine; said box comprising:

(a) a first side wall;

(b) a second side wall; and (c) a base member having a first end and a second end;

said base member extending between said first and second side walls and being reversible to allow either said first or second end thereof to be attached to either said first or second side wall; said first water supply line and said first water hose being attachable to said base member adjacent said first end thereof, said second water supply line and said second water hose being attachable to said base member intermediate said first and second ends thereof, said drain line and said drain hose being attachable to said base member adjacent said second end thereof.

2. The box of claim 1 in which is included attachment means for allowing said base member to be removably secured to said side walls.

3. The box of claim 2 in which said base member has an upwardly directed groove extending about the periphery thereof for receiving the lower ends of said walls.

4. The box of claim 1 in which is included a first valve member attached to said base member adjacent said first end thereof for being coupled to said first water supply line and said first water hose.

5. The box of claim 4 in which is included a second valve member attached to said base member intermediate said first and second ends thereof for being coupled to said second water supply line and said second water hose.

6. The box of claim 5 in which said base member has a first aperture therethrough substantially adjacent said first end thereof for allowing said first valve member to be coupled thereto, and has a second aperture therethrough substantially intermediate said first and second ends thereof for allowing said second valve member to be coupled thereto.

7. The box of claim 6 in which is included drain coupling means attached to said base member adjacent said second end thereof for allowing said drain line and said drain hose to be operatively coupled to one another and to said base member.

8. The box of claim 7 in which said drain coupling means is defined in part by an aperture through said base member substantially adjacent said second end thereof.

9. The box of claim 7 in which said drain coupling means includes a sleeve member attached to said base member substantially adjacent said second end thereof for receiving said drain line and said drain hose.

10. The box of claim 9 in which said drain coupling means includes a cap for temporarily closing said sleeve member prior to said drain hose being coupled thereto.

11. The box of claim 10 in which the outer diameter of said cap is larger than the inner diameter of said drain line to prevent said cap from falling into said drain line.

12. The box of claim 9 in which said sleeve member has an inwardly directed lip substantially adjacent the upper end thereof to act as a stop for the upper end of the drain line.

13. The box of claim 1 in which is included first and second ear members extending outward of said first and second side walls for allowing said box to be secured to said two adjacent studs.

14. The box of claim 13 in which said first ear member is longer than said second ear member to allow said box to be secured closer to one of said two adjacent studs than the other.

15. The box of claim 14 in which said ear members are removably attached to said side walls to allow either of said ear members to be attached to either of said side walls.

16. The box of claim 15 in which in included a face plate for being removably and adjustably attached to the front of said side walls.

17. A reversible side outlet washing machine box for being mounted between two adjacent studs in a wall and for allowing hot and cold water supply lines and a drain line to be coupled to the hot and cold water hoses and drain hose, respectively, of a washing machine; said box comprising:

(a) an open face frame including a first side wall, a second side wall and a base member having a first end and a second end; said base member extending between said first and second side walls with said first end being secured to said first side wall and with said second end secured to said second side wall and being reversible to allow said second end to be secured to said first side wall and said first end to be secured to said second side wall;

(b) a first valve member attached to said base member adjacent said first end thereof for being coupled to one of said water supply lines and to the corresponding one of said water hoses;

(c) a drain coupling member attached to said base member adjacent said second end thereof for being coupled to said drain line and to said drain hose; and (d) a second valve member attached to said base member between said first and second ends thereof for being coupled to the other of said water supply lines and to the corresponding one of said water hoses.

* * * * *